US008146796B2

(12) United States Patent
D'Amato

(10) Patent No.: US 8,146,796 B2
(45) **Date of Patent: *Apr. 3, 2012**

(54) CARDBOARD CONTAINER FOR DRINKS AND PROCESS THEREFOR

(75) Inventor: Gianfranco D'Amato, Arzano (IT)

(73) Assignee: Seda S.p.A., Arzano (IT)

( * ) Notice: Subject to any disclaimer, the term of this patent is extended or adjusted under 35 U.S.C. 154(b) by 0 days.

This patent is subject to a terminal disclaimer.

(21) Appl. No.: 11/408,203

(22) Filed: Apr. 21, 2006

(65) Prior Publication Data

US 2006/0186012 A1 Aug. 24, 2006

Related U.S. Application Data

(63) Continuation of application No. 10/470,431, filed as application No. PCT/EP02/00346 on Jan. 15, 2002, now Pat. No. 7,100,770.

(30) Foreign Application Priority Data

Jan. 30, 2001 (EP) ..... 01830056

(51) Int. Cl.
*B65D 3/22* (2006.01)
*B65D 21/04* (2006.01)
*B31B 1/28* (2006.01)

(52) U.S. Cl. ..... 229/403; 206/505; 206/518; 206/519; 206/520; 493/58; 493/111; 493/112; 493/114; 493/152; 493/159

(58) Field of Classification Search ..... 229/400, 229/403; 206/505, 506, 515, 518–520; 493/58, 493/111, 112, 114, 152, 154, 155, 158, 159
See application file for complete search history.

(56) References Cited

U.S. PATENT DOCUMENTS

| | | | |
|---|---|---|---|
| 23,200 | A | 3/1859 | Stimpson |
| 1,031,514 | A | 7/1912 | Bjorkstam |
| 1,520,870 | A | 12/1924 | Koch |
| 1,549,417 | A | 8/1925 | Hendrich |
| 1,615,319 | A | 1/1927 | Wynn |
| 1,654,318 | A | 12/1927 | Benson |
| 1,685,494 | A | 9/1928 | Koch |
| 1,706,910 | A | 3/1929 | Wright et al. |
| 1,756,243 | A | 4/1930 | Benson |
| 1,759,407 | A | 5/1930 | Kingsbury |
| 1,814,671 | A | 7/1931 | Dufour |
| 2,053,726 | A | 9/1936 | Marshall |
| 2,134,427 | A | 10/1938 | Biderman |
| 2,156,328 | A | 5/1939 | Cesare |

(Continued)

FOREIGN PATENT DOCUMENTS

AR 047625 2/2006

(Continued)

OTHER PUBLICATIONS

Reexamination appl. #95/001370, complete prosecution reviewed.*

(Continued)

*Primary Examiner* — Gary E Elkins
(74) *Attorney, Agent, or Firm* — Fish & Richardson P.C.

(57) ABSTRACT

A cardboard container for drinks and a process for making it is provided. The container has a perimetral wall (2) and a bottom wall and includes elements (4) for supporting another such container (1) nested inside.

15 Claims, 3 Drawing Sheets

U.S. PATENT DOCUMENTS

| | | | |
|---|---|---|---|
| 2,157,054 | A | 5/1939 | Gammeter |
| 2,288,602 | A | 5/1939 | Benton |
| 2,170,060 | A | 8/1939 | Meyer |
| 2,216,331 | A | 10/1940 | Swallow et al. |
| 2,226,340 | A | 12/1940 | Flood |
| 2,235,963 | A | 3/1941 | McGirr et al. |
| 2,240,599 | A | 5/1941 | Amberg |
| 2,266,828 | A | 12/1941 | Sykes |
| 2,416,813 | A | 3/1947 | Cesare |
| 2,462,497 | A | 2/1949 | Heyman |
| 2,493,633 | A | 1/1950 | Mart |
| 2,540,565 | A | 2/1951 | Barbieri |
| 2,563,352 | A | 8/1951 | Morse |
| 2,591,578 | A | 4/1952 | McNealy et al. |
| 2,661,889 | A | 12/1953 | Phinney |
| 2,666,542 | A | 1/1954 | Price |
| 2,675,954 | A | 4/1954 | Vogel |
| 2,689,424 | A | 9/1954 | Clagett |
| 2,692,722 | A | 10/1954 | Johnson |
| 2,695,744 | A | 11/1954 | Gattuso |
| 2,721,686 | A | 10/1955 | Reifsnyder et al. |
| 2,725,733 | A | 12/1955 | Howlett |
| 2,740,575 | A | 4/1956 | Fontaine |
| 2,828,903 | A | 4/1958 | Adkins |
| 2,863,585 | A | 12/1958 | Meshberg |
| 2,888,861 | A | 6/1959 | Meyer-Jagenberg |
| 2,899,098 | A | 8/1959 | Gits |
| 2,982,465 | A | 5/1961 | Fallert |
| 3,065,875 | A | 11/1962 | Negoro |
| 3,079,027 | A | 2/1963 | Edwards |
| 3,082,900 | A | 3/1963 | Goodman |
| 3,109,252 | A | 11/1963 | Schellenberg |
| 3,118,351 | A | 1/1964 | Meyer-Jagenberg |
| 3,139,213 | A | 6/1964 | Edwards |
| RE25,618 | E | 7/1964 | Goodman |
| 3,208,631 | A | 9/1965 | Bryant |
| 3,225,954 | A | 12/1965 | Herrick et al. |
| 3,232,512 | A | 2/1966 | Wanderer |
| 3,298,893 | A | 1/1967 | Allen |
| 3,355,046 | A | 11/1967 | Jolly |
| 3,357,053 | A | 12/1967 | Lyon et al. |
| 3,372,830 | A | 3/1968 | Edwards |
| 3,401,862 | A | 9/1968 | Wanderer |
| 3,428,214 | A | 2/1969 | Leon |
| 3,443,714 | A | 5/1969 | Edwards |
| 3,456,860 | A | 7/1969 | Janninck |
| 3,471,075 | A | 10/1969 | Wolf |
| 3,485,412 | A | 12/1969 | Hawley |
| 3,526,316 | A | 9/1970 | Kalogris |
| 3,531,015 | A | 9/1970 | Makin |
| 3,580,468 | A | 5/1971 | McDevitt |
| 3,583,596 | A | 6/1971 | Brewer |
| 3,612,346 | A | 10/1971 | Schneider |
| 3,645,758 | A | 2/1972 | MacManus |
| 3,700,018 | A | 10/1972 | Goglio |
| 3,737,093 | A | 6/1973 | Amberg et al. |
| 3,739,975 | A | 6/1973 | Davidow |
| 3,747,830 | A | 7/1973 | Goldman |
| 3,749,277 | A | 7/1973 | Kinney |
| 3,765,559 | A | 10/1973 | Sauey et al. |
| 3,766,975 | A | 10/1973 | Todd |
| D231,068 | S | 4/1974 | Douglas |
| 3,836,207 | A | 9/1974 | Belart |
| 3,846,207 | A | 11/1974 | MacDaniel et al. |
| 3,850,361 | A | 11/1974 | Day et al. |
| 3,878,282 | A | 4/1975 | Bonis et al. |
| 3,884,350 | A | 5/1975 | Johansson |
| 3,908,523 | A | 9/1975 | Shikaya |
| 3,926,361 | A | 12/1975 | Hilderbrand |
| 3,927,766 | A | 12/1975 | Day |
| 3,934,749 | A | 1/1976 | Andrulionis |
| 3,955,697 | A | 5/1976 | Valyi |
| 3,980,107 | A | 9/1976 | Barnes et al. |
| 4,007,670 | A | 2/1977 | Albano et al. |
| 4,018,904 | A | 4/1977 | Muraoka |
| 4,040,537 | A | 8/1977 | Edwards |
| 4,049,122 | A | 9/1977 | Maxwell |
| 4,070,953 | A | 1/1978 | Richards et al. |
| 4,089,358 | A | 5/1978 | Korson |
| 4,102,454 | A | 7/1978 | Karevaara |
| 4,124,120 | A | 11/1978 | Day |
| 4,129,065 | A | 12/1978 | Corse |
| 4,187,768 | A | 2/1980 | Suzuki |
| 4,211,024 | A | 7/1980 | Nickell |
| 4,231,476 | A | 11/1980 | Compton et al. |
| 4,261,501 | A | 4/1981 | Watkins et al. |
| 4,292,194 | A | 9/1981 | Perazzoni et al. |
| 4,308,679 | A | 1/1982 | Ray, III et al. |
| 4,318,235 | A | 3/1982 | Augeri |
| 4,324,338 | A | 4/1982 | Beall |
| 4,327,136 | A | 4/1982 | Thompson et al. |
| 4,344,814 | A | 8/1982 | McLaren |
| 4,345,393 | A | 8/1982 | Price et al. |
| 4,368,818 | A | 1/1983 | Day et al. |
| 4,409,045 | A | 10/1983 | Busse |
| 4,409,122 | A | 10/1983 | Kleuskens et al. |
| 4,514,242 | A | 4/1985 | MacLaughlin et al. |
| 4,548,348 | A | 10/1985 | Clements |
| 4,551,365 | A | 11/1985 | Bonis |
| 4,560,075 | A | 12/1985 | Lu |
| 4,571,233 | A | 2/1986 | Konzal |
| 4,574,987 | A | 3/1986 | Halligan et al. |
| 4,581,003 | A | 4/1986 | Ito et al. |
| 4,684,553 | A | 8/1987 | Sasaki et al. |
| 4,706,873 | A | 11/1987 | Schulz |
| 4,771,911 | A | 9/1988 | Morony et al. |
| 4,775,523 | A | 10/1988 | Sparacio et al. |
| 4,789,073 | A | 12/1988 | Fine |
| 4,792,042 | A | 12/1988 | Koehn et al. |
| 4,813,862 | A | 3/1989 | Bowers et al. |
| 4,850,496 | A | 7/1989 | Rudell et al. |
| 4,863,014 | A | 9/1989 | Summons et al. |
| 4,936,448 | A | 6/1990 | Holloway |
| 4,993,580 | A | 2/1991 | Smith |
| 4,997,691 | A | 3/1991 | Parkinson |
| 5,007,578 | A | 4/1991 | Simone |
| 5,021,274 | A | 6/1991 | Beck et al. |
| 5,025,981 | A | 6/1991 | Schellenberg |
| 5,062,568 | A | 11/1991 | Hill et al. |
| 5,076,463 | A | 12/1991 | McGraw |
| 5,078,313 | A | 1/1992 | Matheson et al. |
| 5,092,485 | A | 3/1992 | Lee |
| 5,135,132 | A | 8/1992 | Potochnik |
| 5,145,107 | A | 9/1992 | Silver et al. |
| 5,226,585 | A | 7/1993 | Varano |
| 5,253,781 | A | 10/1993 | Van Melle et al. |
| 5,363,982 | A | 11/1994 | Sadlier |
| 5,385,260 | A * | 1/1995 | Gatcomb ..... 229/400 |
| 5,395,005 | A | 3/1995 | Yoshida |
| 5,425,497 | A | 6/1995 | Sorensen |
| 5,425,498 | A | 6/1995 | Hallam et al. |
| 5,460,323 | A | 10/1995 | Titus |
| 5,484,167 | A | 1/1996 | Donaldson et al. |
| 5,489,063 | A | 2/1996 | Buchalski et al. |
| 5,524,817 | A | 6/1996 | Meier et al. |
| 5,542,599 | A | 8/1996 | Sobol |
| 5,547,124 | A | 8/1996 | Mueller |
| 5,551,592 | A | 9/1996 | Barton et al. |
| 5,553,735 | A | 9/1996 | Kimura |
| 5,573,141 | A | 11/1996 | Chen |
| 5,586,689 | A | 12/1996 | D'Amato |
| 5,593,053 | A | 1/1997 | Kaufman et al. |
| 5,603,450 | A | 2/1997 | Whitnell |
| 5,628,453 | A | 5/1997 | MacLaughlin |
| 5,660,326 | A | 8/1997 | Varano et al. |
| 5,660,898 | A | 8/1997 | Calvert |
| 5,671,353 | A | 9/1997 | Tian et al. |
| 5,674,546 | A | 10/1997 | Barnes et al. |
| 5,678,725 | A | 10/1997 | Yamada et al. |
| 5,685,480 | A | 11/1997 | Choi |
| 5,697,550 | A | 12/1997 | Varano et al. |
| 5,713,512 | A | 2/1998 | Barrett |
| 5,752,653 | A | 5/1998 | Razzaghi |
| RE35,830 | E | 6/1998 | Sadlier |
| 5,769,262 | A | 6/1998 | Yamada et al. |
| 5,769,311 | A | 6/1998 | Morita et al. |
| 5,772,111 | A | 6/1998 | Kirsch |

| | | | |
|---|---|---|---|
| 5,794,843 | A | 8/1998 | Sanchez |
| 5,820,016 | A | 10/1998 | Stropkay |
| 5,823,948 | A | 10/1998 | Ross, Jr. et al. |
| 5,839,599 | A | 11/1998 | Lin |
| 5,839,653 | A | 11/1998 | Zadravetz |
| 5,894,948 | A | 4/1999 | Yeh |
| 5,903,889 | A | 5/1999 | de la Huerga et al. |
| 5,913,449 | A | 6/1999 | Branch et al. |
| 5,918,761 | A | 7/1999 | Wissinger |
| 5,944,208 | A | 8/1999 | Gale |
| 5,950,917 | A | 9/1999 | Smith |
| 5,953,419 | A | 9/1999 | Lohstroh et al. |
| 5,954,217 | A | 9/1999 | Brkovic et al. |
| 5,956,400 | A | 9/1999 | Chaum et al. |
| 5,964,400 | A | 10/1999 | Varano et al. |
| 5,975,344 | A | 11/1999 | Stevens |
| 5,996,887 | A | 12/1999 | Cai et al. |
| 6,036,801 | A | 3/2000 | Yamada et al. |
| 6,047,488 | A | 4/2000 | Tuszkiewicz |
| 6,050,443 | A | 4/2000 | Tung |
| 6,056,144 | A | 5/2000 | Strange et al. |
| 6,065,632 | A | 5/2000 | Moore, Jr. |
| 6,068,181 | A | 5/2000 | Cai |
| 6,076,699 | A | 6/2000 | Seager et al. |
| 6,085,970 | A | 7/2000 | Sadlier |
| 6,109,518 | A | 8/2000 | Mueller et al. |
| 6,116,503 | A | 9/2000 | Varano |
| 6,126,584 | A | 10/2000 | Zadravetz |
| 6,145,656 | A | 11/2000 | Marco |
| 6,148,342 | A | 11/2000 | Ho |
| 6,161,720 | A | 12/2000 | Castle |
| 6,193,098 | B1 | 2/2001 | Mochizuki et al. |
| 6,196,454 | B1 | 3/2001 | Sadlier |
| 6,210,766 | B1 | 4/2001 | McLaughlin |
| 6,224,954 | B1 | 5/2001 | Mitchell et al. |
| 6,237,845 | B1 | 5/2001 | Hashimoto et al. |
| 6,253,995 | B1 | 7/2001 | Blok et al. |
| 6,257,485 | B1 | 7/2001 | Sadlier et al. |
| 6,260,021 | B1 | 7/2001 | Wong et al. |
| 6,260,756 | B1 | 7/2001 | Mochizuki et al. |
| 6,263,330 | B1 | 7/2001 | Bessette et al. |
| 6,265,040 | B1 | 7/2001 | Neale et al. |
| 6,286,754 | B1 | 9/2001 | Stier et al. |
| 6,287,247 | B1 | 9/2001 | Dees et al. |
| 6,315,150 | B1 | 11/2001 | Takai et al. |
| 6,315,192 | B1 | 11/2001 | Marlow |
| 6,332,538 | B1 | 12/2001 | Pritchard |
| 6,343,735 | B1 | 2/2002 | Cai |
| 6,367,652 | B1 | 4/2002 | Toida et al. |
| 6,378,763 | B1 | 4/2002 | Nelson et al. |
| 6,378,766 | B2 | 4/2002 | Sadlier |
| 6,382,449 | B1 | 5/2002 | Kazmierski et al. |
| 6,401,955 | B1 | 6/2002 | Yang et al |
| 6,419,108 | B1 | 7/2002 | Toida et al. |
| 6,422,456 | B1 | 7/2002 | Sadlier |
| 6,424,996 | B1 | 7/2002 | Killcommons et al. |
| 6,449,621 | B1 | 9/2002 | Pettovello |
| 6,457,585 | B1 | 10/2002 | Huffer et al. |
| 6,463,417 | B1 | 10/2002 | Schoenberg |
| 6,557,102 | B1 | 4/2003 | Wong et al. |
| 6,557,751 | B2 | 5/2003 | Puerini |
| 6,562,270 | B1 | 5/2003 | Gannon et al. |
| 6,568,587 | B1 | 5/2003 | Yamada et al. |
| 6,574,629 | B1 | 6/2003 | Cooke, Jr. et al. |
| 6,574,742 | B1 | 6/2003 | Jamroga et al. |
| 6,598,786 | B1 | 7/2003 | Guo |
| 6,611,846 | B1 | 8/2003 | Stoodley et al. |
| 6,612,456 | B1 | 9/2003 | Hundley et al. |
| 6,648,176 | B1 | 11/2003 | Donovan |
| 6,651,060 | B1 | 11/2003 | Harper et al. |
| 6,663,926 | B1 | 12/2003 | Okushita et al. |
| 6,678,703 | B2 | 1/2004 | Rothschild et al. |
| 6,678,764 | B2 | 1/2004 | Parvulescu et al. |
| 6,688,487 | B2 | 2/2004 | Oakes et al. |
| 6,691,134 | B1 | 2/2004 | Babula et al. |
| 6,738,798 | B1 | 5/2004 | Ploetz et al. |
| 6,746,743 | B2 | 6/2004 | Knoerzer et al. |
| 6,749,913 | B2 | 6/2004 | Watanabe et al. |
| 6,763,344 | B1 | 7/2004 | Osentoski et al. |
| 6,775,670 | B2 | 8/2004 | Bessette |
| 6,811,843 | B2 | 11/2004 | DeBraal et al. |
| 6,852,381 | B2 | 2/2005 | Debraal et al. |
| 6,908,651 | B2 | 6/2005 | Watanabe et al. |
| 6,921,179 | B2 | 7/2005 | Diak Ghanem |
| 6,926,197 | B2 | 8/2005 | Hed et al. |
| 6,989,198 | B2 | 1/2006 | Masuda et al. |
| 7,100,770 | B2 * | 9/2006 | D'Amato ..... 206/505 |
| 7,117,579 | B2 | 10/2006 | Schellenberg |
| 7,172,086 | B2 | 2/2007 | McKendry et al. |
| 7,175,585 | B2 | 2/2007 | Okushita et al. |
| 7,195,805 | B2 | 3/2007 | Breining et al. |
| D546,625 | S | 7/2007 | Gluck |
| D547,122 | S | 7/2007 | Gluck |
| D550,033 | S | 9/2007 | Bodum |
| D550,034 | S | 9/2007 | Bodum |
| D551,502 | S | 9/2007 | Bodum |
| D553,437 | S | 10/2007 | Bodum |
| D553,439 | S | 10/2007 | Bodum |
| D553,440 | S | 10/2007 | Bodum |
| D553,442 | S | 10/2007 | Bodum |
| D553,909 | S | 10/2007 | Bodum |
| D553,910 | S | 10/2007 | Bodum |
| D553,911 | S | 10/2007 | Bodum |
| 7,281,650 | B1 | 10/2007 | Milan |
| D557,561 | S | 12/2007 | Flowers et al. |
| D557,563 | S | 12/2007 | Bodum |
| D557,564 | S | 12/2007 | Bodum |
| 7,306,113 | B2 | 12/2007 | El-Saden et al. |
| D562,075 | S | 2/2008 | Mehta |
| D563,172 | S | 3/2008 | Bodum |
| 7,344,038 | B2 | 3/2008 | Elansary |
| D577,260 | S | 9/2008 | Bodum |
| 7,451,910 | B2 | 11/2008 | Frost et al. |
| 7,451,911 | B2 | 11/2008 | Stepanek, Jr. |
| D581,738 | S | 12/2008 | Bodum |
| D581,739 | S | 12/2008 | Bodum |
| 7,458,504 | B2 | 12/2008 | Robertson et al. |
| 7,481,356 | B2 | 1/2009 | Stahlecker et al. |
| 7,536,767 | B2 | 5/2009 | Hollis et al. |
| D594,277 | S | 6/2009 | Snell |
| D595,090 | S | 6/2009 | Benson |
| 7,552,841 | B2 | 6/2009 | Hollis et al. |
| D597,791 | S | 8/2009 | Lion et al. |
| D597,792 | S | 8/2009 | Lion et al. |
| 7,597,246 | B2 | 10/2009 | Stepanek, Jr. |
| 7,631,781 | B2 | 12/2009 | Chen |
| 7,677,435 | B2 | 3/2010 | Stahlecker |
| 7,694,843 | B2 | 4/2010 | Hollis et al. |
| 7,699,216 | B2 | 4/2010 | Smith et al. |
| 7,717,325 | B2 | 5/2010 | Puls et al. |
| 2001/0013537 | A1 | 8/2001 | Sadlier |
| 2001/0032100 | A1 | 10/2001 | Mahmud et al. |
| 2001/0041991 | A1 | 11/2001 | Segal et al. |
| 2002/0010679 | A1 | 1/2002 | Felsher |
| 2002/0043555 | A1 | 4/2002 | Mader |
| 2002/0148832 | A1 | 10/2002 | Breining et al. |
| 2002/0156650 | A1 | 10/2002 | Klein et al. |
| 2002/0172818 | A1 | 11/2002 | DeBraal et al. |
| 2003/0029876 | A1 | 2/2003 | Giraud |
| 2003/0088441 | A1 | 5/2003 | McNerney |
| 2003/0116576 | A1 | 6/2003 | Lang-Boecker |
| 2003/0121189 | A1 | 7/2003 | Williams |
| 2003/0121963 | A1 | 7/2003 | Van Handel |
| 2003/0140044 | A1 | 7/2003 | Mok et al. |
| 2003/0226882 | A1 | 12/2003 | Porchia et al. |
| 2004/0034550 | A1 | 2/2004 | Menschik et al. |
| 2004/0069311 | A1 | 4/2004 | Sasaki et al. |
| 2004/0094612 | A1 | 5/2004 | D'Amato |
| 2004/0112949 | A1 | 6/2004 | Hed et al. |
| 2004/0133797 | A1 | 7/2004 | Arnold |
| 2004/0139222 | A1 | 7/2004 | Slik et al. |
| 2004/0154156 | A1 | 8/2004 | Schellenberg |
| 2004/0199765 | A1 | 10/2004 | Kohane et al. |
| 2004/0226948 | A1 | 11/2004 | Okushita et al. |
| 2005/0006385 | A1 | 1/2005 | D'Amato |
| 2005/0029337 | A1 | 2/2005 | Van Handel |
| 2005/0040218 | A1 | 2/2005 | Hinchey et al. |
| 2005/0045643 | A1 | 3/2005 | Ghanem |

| | | | |
|---|---|---|---|
| 2005/0115975 | A1 | 6/2005 | Smith et al. |
| 2005/0184074 | A1 | 8/2005 | Simmons et al. |
| 2005/0199697 | A1 | 9/2005 | Nugent |
| 2005/0205651 | A1 | 9/2005 | Marx |
| 2005/0236468 | A1 | 10/2005 | Sadlier |
| 2005/0258225 | A1 | 11/2005 | Martin |
| 2005/0269390 | A1 | 12/2005 | Martin |
| 2006/0038001 | A1 | 2/2006 | Stepanek |
| 2006/0118608 | A1 | 6/2006 | Stahlecker |
| 2006/0131316 | A1 | 6/2006 | Bresler |
| 2006/0144915 | A1 | 7/2006 | Sadlier |
| 2006/0186012 | A1 | 8/2006 | D'Amato |
| 2006/0226210 | A1 | 10/2006 | Stahlecker |
| 2006/0237465 | A1 | 10/2006 | D'Amato |
| 2006/0283855 | A1 | 12/2006 | Hollis et al. |
| 2006/0289610 | A1 | 12/2006 | Kling |
| 2007/0262129 | A1 | 11/2007 | Zadravetz |
| 2007/0284426 | A1 | 12/2007 | Lo |
| 2008/0006643 | A1 | 1/2008 | Ma |
| 2008/0023536 | A1 | 1/2008 | Frost et al. |
| 2008/0023537 | A1 | 1/2008 | Frost et al. |
| 2008/0023538 | A1 | 1/2008 | Robertson et al. |
| 2008/0029588 | A1 | 2/2008 | Messerschmid et al. |
| 2008/0078825 | A1 | 4/2008 | Puls et al. |
| 2008/0087677 | A1 | 4/2008 | Robertson et al. |
| 2008/0087715 | A1 | 4/2008 | Robertson et al. |
| 2008/0087716 | A1 | 4/2008 | Sadlier |
| 2008/0093434 | A1 | 4/2008 | Van Handel |
| 2008/0105692 | A1 | 5/2008 | Hiromori |
| 2008/0105693 | A1 | 5/2008 | Hechmati |
| 2008/0121681 | A1 | 5/2008 | Wiedmeyer |
| 2008/0128433 | A1 | 6/2008 | Stauffer et al. |
| 2008/0128481 | A1 | 6/2008 | Robertson |
| 2008/0156857 | A1 | 7/2008 | Johnston |
| 2008/0169297 | A1 | 7/2008 | Kelly |
| 2008/0264937 | A1 | 10/2008 | D'Amato |
| 2008/0272118 | A1 | 11/2008 | Wang |
| 2008/0280743 | A1 | 11/2008 | Stahlecker et al. |
| 2008/0302800 | A1 | 12/2008 | Chou |
| 2008/0308620 | A1 | 12/2008 | Stepanek, Jr. |
| 2008/0314909 | A1 | 12/2008 | Takeo et al. |
| 2009/0020597 | A1 | 1/2009 | D'Amato |
| 2009/0110782 | A1 | 4/2009 | Mellor |
| 2009/0121007 | A1 | 5/2009 | Van Handel |
| 2009/0159653 | A1 | 6/2009 | Stahlecker |
| 2009/0166402 | A1 | 7/2009 | D'amato |
| 2009/0170680 | A1 | 7/2009 | D'amato |
| 2009/0184020 | A1 | 7/2009 | Messerschmid et al. |
| 2009/0218390 | A1 | 9/2009 | Chang |
| 2009/0230178 | A1 | 9/2009 | Stahlecker et al. |
| 2009/0294456 | A1 | 12/2009 | Messerschmid |
| 2009/0294520 | A1 | 12/2009 | Stepanek, Jr. |
| 2009/0321440 | A1 | 12/2009 | Fedusa et al. |
| 2009/0321508 | A1 | 12/2009 | Fu et al. |
| 2010/0025283 | A1 | 2/2010 | Oshima et al. |
| 2010/0044424 | A1 | 2/2010 | Van Handel |
| 2010/0065622 | A1 | 3/2010 | Chang |
| 2010/0072268 | A1 | 3/2010 | Johnson et al. |
| 2010/0160130 | A1 | 6/2010 | Messerschmid |
| 2010/0187296 | A1 | 7/2010 | Puls et al. |

FOREIGN PATENT DOCUMENTS

| | | | |
|---|---|---|---|
| AT | 141212 | T | 8/1996 |
| AT | 263709 | T | 4/2004 |
| AU | 4557993 | A | 3/1994 |
| AU | 2008264158 | A1 | 8/2009 |
| AU | 2009200641 | A1 | 10/2009 |
| BE | 410215 | A | 7/1935 |
| BE | 897862 | A1 | 3/1984 |
| BR | PI0900078 | A2 | 9/2009 |
| CA | 742539 | | 9/1966 |
| CA | 837922 | | 3/1970 |
| CA | 844949 | | 6/1970 |
| CA | 1007182 | | 3/1977 |
| CA | 1082657 | | 7/1980 |
| CA | 1125680 | | 6/1982 |
| CA | 1125681 | | 6/1982 |
| CA | 1152011 | | 8/1983 |
| CA | 1239885 | | 8/1988 |
| CA | 1249232 | | 1/1989 |
| CA | 1257209 | | 7/1989 |
| CA | 2021035 | A1 | 1/1991 |
| CA | 2026197 | | 8/1991 |
| CA | 2060135 | | 7/1992 |
| CA | 2150306 | | 2/1996 |
| CA | 2043958 | | 7/1996 |
| CA | 2250677 | | 4/2000 |
| CA | 2286498 | A1 | 4/2000 |
| CA | 2176080 | | 8/2001 |
| CA | 2228749 | | 10/2001 |
| CA | 2141730 | | 5/2002 |
| CA | 2197976 | | 5/2002 |
| CA | 2432791 | | 6/2002 |
| CA | 2165509 | | 7/2002 |
| CA | 2436505 | A1 | 8/2002 |
| CA | 2233356 | | 11/2002 |
| CA | 2431542 | | 12/2002 |
| CA | 2431869 | | 12/2002 |
| CA | 2219845 | | 4/2003 |
| CA | 2244689 | | 9/2003 |
| CA | 2271581 | | 12/2003 |
| CA | 2121491 | | 7/2004 |
| CA | 2542905 | A1 | 1/2005 |
| CA | 2564012 | | 11/2005 |
| CA | 114070 | | 2/2006 |
| CA | 2520024 | | 3/2006 |
| CA | 2262802 | | 6/2006 |
| CA | 2549450 | | 12/2006 |
| CA | 2608826 | | 12/2006 |
| CA | 2262458 | | 1/2007 |
| CA | 2613109 | | 1/2007 |
| CA | 2621453 | | 3/2007 |
| CA | 113773 | | 4/2007 |
| CA | 119089 | | 5/2007 |
| CA | 119090 | | 5/2007 |
| CA | 119091 | | 5/2007 |
| CA | 119092 | | 5/2007 |
| CA | 2629190 | | 5/2007 |
| CA | 118452 | | 7/2007 |
| CA | 113355 | | 9/2007 |
| CA | 115931 | | 10/2007 |
| CA | 116240 | | 10/2007 |
| CA | 116241 | | 10/2007 |
| CA | 116438 | | 10/2007 |
| CA | 119239 | | 10/2007 |
| CA | 120446 | | 10/2007 |
| CA | 2545497 | | 11/2007 |
| CA | 2588413 | | 11/2007 |
| CA | 2657721 | A1 | 1/2008 |
| CA | 116480 | | 2/2008 |
| CA | 2598153 | | 2/2008 |
| CA | 120610 | | 3/2008 |
| CA | 2520677 | | 4/2008 |
| CA | 2664625 | | 4/2008 |
| CA | 2665633 | | 4/2008 |
| CA | 114549 | | 5/2008 |
| CA | 121962 | | 5/2008 |
| CA | 2610053 | | 5/2008 |
| CA | 122120 | | 6/2008 |
| CA | 122879 | | 7/2008 |
| CA | 2267361 | | 10/2008 |
| CA | 2598691 | | 5/2009 |
| CA | 2347777 | | 7/2009 |
| CA | 2706374 | | 7/2009 |
| CA | 2311825 | | 10/2009 |
| CA | 2405786 | | 11/2009 |
| CA | 2394475 | | 1/2010 |
| CA | 128485 | | 2/2010 |
| CH | 678938 | A5 | 11/1991 |
| CN | 1082987 | A | 3/1994 |
| CN | 1128744 | A | 8/1996 |
| CN | 1237133 | A | 12/1999 |
| CN | 1272089 | A | 11/2000 |
| CN | 1288427 | A | 3/2001 |
| CN | 2484866 | Y | 4/2002 |
| CN | 2526274 | Y | 12/2002 |
| CN | 1489541 | A | 4/2004 |
| CN | 1781813 | A | 6/2006 |

| | | | |
|---|---|---|---|
| CN | 101489771 | A | 7/2009 |
| CN | 101492107 | A | 7/2009 |
| CN | 101531070 | A | 9/2009 |
| DE | 652737 | C | 11/1937 |
| DE | 18806777 | | 5/1963 |
| DE | 11 91 285 | A | 4/1965 |
| DE | 2001499 | | 7/1970 |
| DE | 8301046.7 | | 6/1983 |
| DE | 3335833 | A1 | 4/1984 |
| DE | 9115069 | U1 | 1/1992 |
| DE | 9215015 | U1 | 1/1993 |
| DE | 59002814 | | 10/1993 |
| DE | 42 26 313 | | 2/1994 |
| DE | 4393650 | | 11/1995 |
| DE | 44 21 870 | A1 | 1/1996 |
| DE | 59303454 | | 9/1996 |
| DE | 19517392 | | 11/1996 |
| DE | 198 40 841 | A1 | 3/2000 |
| DE | 19840841 | A1 | 3/2000 |
| DE | 10056811 | A1 | 7/2001 |
| DE | 10054727 | A1 | 5/2002 |
| DE | 20110390 | | 12/2002 |
| DE | 20310623 | U1 | 11/2003 |
| DE | 60102661 | T2 | 8/2004 |
| DE | 102004056932 | A1 | 5/2006 |
| DE | 102005017741 | A1 | 10/2006 |
| DE | 102006025612 | A1 | 11/2007 |
| DE | 102007024243 | A1 | 1/2008 |
| DE | 102007024254 | A1 | 1/2008 |
| DE | 102007030864 | A1 | 1/2008 |
| DE | 102008005403 | A1 | 7/2009 |
| DE | 102008014878 | A1 | 9/2009 |
| EA | 200900031 | A1 | 8/2009 |
| EP | 0074936 | A2 | 3/1983 |
| EP | 0108264 | | 10/1983 |
| EP | 0102149 | A2 | 3/1984 |
| EP | 0371918 | | 6/1990 |
| EP | 0408515 | A1 | 1/1991 |
| EP | 0512179 | | 11/1992 |
| EP | 0512179 | A1 | 11/1992 |
| EP | 0653983 | A1 | 5/1995 |
| EP | 0659647 | | 6/1995 |
| EP | 0683033 | | 11/1995 |
| EP | 0688720 | | 12/1995 |
| EP | 0695692 | | 2/1996 |
| EP | 0765821 | | 4/1997 |
| EP | 0812668 | | 12/1997 |
| EP | 0929455 | | 7/1999 |
| EP | 0934202 | | 8/1999 |
| EP | 0934202 | A1 | 8/1999 |
| EP | 0940240 | | 9/1999 |
| EP | 1 031 514 | | 8/2000 |
| EP | 1029656 | | 8/2000 |
| EP | 1031514 | | 8/2000 |
| EP | 1057733 | A1 | 12/2000 |
| EP | 1060879 | | 12/2000 |
| EP | 1157943 | | 11/2001 |
| EP | 1203728 | A2 | 5/2002 |
| EP | 1227042 | | 7/2002 |
| EP | 1227042 | A1 | 7/2002 |
| EP | 1227043 | | 7/2002 |
| EP | 1254842 | | 11/2002 |
| EP | 1317380 | | 6/2003 |
| EP | 1404580 | | 4/2004 |
| EP | 1404590 | | 4/2004 |
| EP | 1418272 | | 5/2004 |
| EP | 1463670 | | 10/2004 |
| EP | 1479512 | | 11/2004 |
| EP | 1479512 | A2 | 11/2004 |
| EP | 1486424 | | 12/2004 |
| EP | 1512527 | | 3/2005 |
| EP | 1547762 | | 6/2005 |
| EP | 1637457 | | 3/2006 |
| EP | 1670688 | | 6/2006 |
| EP | 1712490 | A2 | 10/2006 |
| EP | 1714912 | | 10/2006 |
| EP | 1719715 | | 11/2006 |
| EP | 1739029 | | 1/2007 |
| EP | 1785370 | A1 | 5/2007 |
| EP | 1876106 | | 1/2008 |
| EP | 1894847 | | 3/2008 |
| EP | 1921023 | | 5/2008 |
| EP | 1939099 | | 7/2008 |
| EP | 1975083 | A2 | 10/2008 |
| EP | 1990184 | | 11/2008 |
| EP | 2043853 | A1 | 4/2009 |
| EP | 2049326 | | 4/2009 |
| EP | 2080715 | | 7/2009 |
| EP | 2080715 | A1 | 7/2009 |
| EP | 2108506 | A2 | 10/2009 |
| EP | 2147871 | | 1/2010 |
| EP | 2199222 | | 6/2010 |
| EP | 2202178 | | 6/2010 |
| EP | 2238046 | | 10/2010 |
| ES | 2045882 | T3 | 1/1994 |
| ES | 2093443 | T3 | 12/1996 |
| ES | 2218361 | T3 | 11/2004 |
| FR | 791981 | A | 12/1935 |
| FR | 14 90 636 | | 6/1967 |
| FR | 2160489 | A1 | 6/1973 |
| FR | 2533894 | | 4/1984 |
| FR | 2825981 | | 6/2001 |
| FR | 2813861 | A1 | 3/2002 |
| GB | 321176 | A | 10/1929 |
| GB | 0445661 | A | 4/1936 |
| GB | 484990 | A | 5/1938 |
| GB | 1261531 | | 1/1972 |
| GB | 1261532 | | 1/1972 |
| GB | 1261533 | | 1/1972 |
| GB | 2016640 | | 9/1979 |
| GB | 1554241 | | 10/1979 |
| GB | 2 044 076 | | 10/1980 |
| GB | 2 055 737 | | 3/1981 |
| GB | 2 061 699 | | 5/1981 |
| GB | 2 073 581 | | 10/1981 |
| GB | 2074124 | A | 10/1981 |
| GB | 2 077 177 | | 12/1981 |
| GB | 2 078 094 | | 1/1982 |
| GB | 2130168 | A | 5/1984 |
| GB | 2333087 | A | 7/1999 |
| GB | 2359295 | | 8/2001 |
| GB | 2420267 | | 5/2006 |
| GB | 2425041 | A | 10/2006 |
| GB | 2426045 | A | 11/2006 |
| GB | 2445287 | A | 7/2008 |
| HK | 1034700 | A1 | 4/2004 |
| HK | 1063172 | A1 | 8/2006 |
| IT | 1366725 | | 2/2006 |
| IT | MI0020060589 | | 6/2006 |
| JP | 50-67002 | | 10/1948 |
| JP | 50052003 | A | 5/1975 |
| JP | 50120802 | A | 10/1975 |
| JP | 51140989 | | 12/1976 |
| JP | 53060441 | | 5/1978 |
| JP | 55134046 | | 10/1980 |
| JP | 56156777 | A | 11/1981 |
| JP | 58-81159 | | 5/1983 |
| JP | 59-94076 | | 5/1984 |
| JP | 60-154235 | | 8/1985 |
| JP | 60-242490 | | 12/1985 |
| JP | 62-143663 | | 6/1987 |
| JP | 2509655 (Y2) | | 8/1989 |
| JP | 2-307738 | | 12/1990 |
| JP | 3023014 | U | 3/1991 |
| JP | 4-032908 | | 2/1992 |
| JP | 04097833 | | 3/1992 |
| JP | 4097833 | A | 3/1992 |
| JP | 4-45215 | | 4/1992 |
| JP | 4-68848 | | 6/1992 |
| JP | 5-84621 | | 11/1993 |
| JP | 06048474 | A | 2/1994 |
| JP | 07-149338 | | 6/1995 |
| JP | 8-207924 | | 8/1996 |
| JP | 8-310571 | | 11/1996 |
| JP | 9-132224 | | 5/1997 |
| JP | 10-175627 | | 6/1998 |
| JP | 10-278931 | | 10/1998 |
| JP | 10-338277 | | 12/1998 |

| | | | |
|---|---|---|---|
| JP | 11314286 | | 11/1999 |
| JP | 11321936 | A | 11/1999 |
| JP | 11342982 | A | 12/1999 |
| JP | 2000033931 | | 2/2000 |
| JP | 2000095228 | | 4/2000 |
| JP | 2000103478 | | 4/2000 |
| JP | 2000103479 | | 4/2000 |
| JP | 2000118520 | | 4/2000 |
| JP | 3063644 | | 5/2000 |
| JP | 2000-203664 | | 7/2000 |
| JP | 2000190943 | | 7/2000 |
| JP | 2000203664 | | 7/2000 |
| JP | 2000-238739 | | 9/2000 |
| JP | 2000281044 | | 10/2000 |
| JP | 2001-2051 | | 1/2001 |
| JP | 2001-98355 | | 4/2001 |
| JP | 2001/098355 | | 4/2001 |
| JP | 2001097355 | | 4/2001 |
| JP | 2001171642 | | 6/2001 |
| JP | 2001180647 | | 7/2001 |
| JP | 2001293802 | | 10/2001 |
| JP | 2001294282 | | 10/2001 |
| JP | 3248718 | A | 2/2002 |
| JP | 3274412 | A | 4/2002 |
| JP | 2002-128049 | | 5/2002 |
| JP | 2003276721 | | 10/2003 |
| JP | 2004/090929 | | 3/2004 |
| JP | 2004090928 | A | 3/2004 |
| JP | 2004090929 | | 3/2004 |
| JP | 2004-99079 | | 4/2004 |
| JP | 2004522654 | T | 7/2004 |
| JP | 2004-314987 | | 11/2004 |
| JP | 2004315065 | | 11/2004 |
| JP | 2006143331 | A | 6/2006 |
| JP | 2008-529549 | | 8/2008 |
| JP | 2009173346 | A | 8/2009 |
| KR | 2006056859 | | 5/2006 |
| NL | 42544 | C | 2/1938 |
| NZ | 506739 | | 11/2001 |
| NZ | 519160 | | 12/2003 |
| SG | 0117419 | A1 | 12/2005 |
| TR | 200400866 | T4 | 6/2004 |
| TW | 393427 | B | 6/2000 |
| TW | 399609 | Y | 7/2000 |
| WO | 9403326 | A1 | 2/1994 |
| WO | 9832601 | A2 | 7/1998 |
| WO | 9911526 | A1 | 3/1999 |
| WO | 9922686 | A1 | 5/1999 |
| WO | 9959883 | A1 | 11/1999 |
| WO | 0017058 | A1 | 3/2000 |
| WO | 0028288 | A1 | 5/2000 |
| WO | WO 01/38180 | | 5/2001 |
| WO | 0204300 | | 1/2002 |
| WO | WO-0204300 | | 1/2002 |
| WO | WO 02/30783 | | 4/2002 |
| WO | 0247523 | A1 | 6/2002 |
| WO | WO 02/49924 | | 6/2002 |
| WO | WO-02060767 | | 8/2002 |
| WO | 03057577 | | 7/2003 |
| WO | WO-03057577 | | 7/2003 |
| WO | WO 2004/103845 | | 12/2004 |
| WO | WO 2005/012114 | | 2/2005 |
| WO | WO 2005/047126 | | 5/2005 |
| WO | 2005054082 | A1 | 6/2005 |
| WO | WO 2005/053487 | | 6/2005 |
| WO | 2005075319 | A1 | 8/2005 |
| WO | 2005100167 | A1 | 10/2005 |
| WO | WO 2005/102847 | | 11/2005 |
| WO | 2007028623 | A1 | 3/2007 |
| WO | WO 2007/036928 | A3 | 4/2007 |
| WO | 2007054179 | A2 | 5/2007 |
| WO | 2007054318 | A1 | 5/2007 |
| WO | WO 2007/078446 | A2 | 7/2007 |
| WO | WO 2007/090415 | A1 | 8/2007 |
| WO | WO 2007/091068 | A2 | 8/2007 |
| WO | WO 2007/094838 | A2 | 8/2007 |
| WO | WO 2007/126783 | A1 | 11/2007 |
| WO | 2008009371 | A1 | 1/2008 |
| WO | 2008009372 | A1 | 1/2008 |
| WO | WO 2008/009372 | | 1/2008 |
| WO | WO 2008/014230 | | 1/2008 |
| WO | WO 2008/809371 | | 1/2008 |
| WO | WO 2008/022180 | A2 | 2/2008 |
| WO | WO 2008/026161 | A2 | 3/2008 |
| WO | WO 2008/042378 | | 4/2008 |
| WO | WO 2008/042378 | A1 | 4/2008 |
| WO | WO 2008/045708 | A1 | 4/2008 |
| WO | WO 2008/045944 | A2 | 4/2008 |
| WO | 2008067865 | A1 | 6/2008 |
| WO | WO 2008/107657 | A1 | 9/2008 |
| WO | WO 2008/119938 | A1 | 10/2008 |
| WO | WO 2008/123783 | A1 | 10/2008 |
| WO | WO 2008/146115 | A1 | 12/2008 |
| WO | WO 2009/021305 | A2 | 2/2009 |
| WO | WO 2009/032837 | A1 | 3/2009 |
| WO | WO 2009/034323 | A2 | 3/2009 |
| WO | WO 2009/039632 | A1 | 4/2009 |
| WO | WO 2009/059352 | A1 | 5/2009 |
| WO | WO 2009/074285 | A2 | 6/2009 |
| WO | 2009092557 | A1 | 7/2009 |
| WO | WO 2009/082660 | A1 | 7/2009 |
| WO | WO 2009/092557 | | 7/2009 |
| WO | WO 2009/118772 | A1 | 10/2009 |
| WO | WO 2010/008629 | A1 | 1/2010 |
| WO | WO 2010/011627 | A1 | 1/2010 |
| WO | WO 2010/019146 | A1 | 2/2010 |
| WO | WO 2010/031764 | A2 | 3/2010 |
| WO | WO 2010/034869 | A1 | 4/2010 |
| WO | WO 2010/036645 | A1 | 4/2010 |
| WO | WO 2010/067047 | A1 | 6/2010 |

OTHER PUBLICATIONS

Statement of case in opposition to New Zealand Patent Application No. 543602, Mar. 22, 2007, 79 pages.

Statement of case in support of Notice of Opposition to Grant of Patent (Section 21) in New Zealand Patent Application No. 543602, Mar. 28, 2007, 16 pages.

International Search Report from International Application No. PCT/EP2006/009933, dated Oct. 4, 2007, 5 pages.

International Search Report mailed Jan. 15, 2007 in PCT/EP2006/008753.

International Search Report from Corresponding International Application No. PCT/EP2005/005406, dated Aug. 25, 2005, 2 pages.

Search Report for DE 203 19 691.0 mailed Aug. 24, 2004.

Decision—Minutes of the oral proceedings before the Opposition Division in EP-B-1785370.

EPO Communication dated Oct. 20, 2010, based on EP 1976683.

Notice of Reasons for Rejection from the Japanese Patent Office in Japanese Patent Appln. No. 2008-539346.

Second Office Action from The State Intellectual Property Office of P.R. China, dated Mar. 21, 2011, for Appln. No. 200480025553.7, issued as 2011031600528500.

Request for Inter Partes Reexamination Under 35 U.S.C. § 331 and 37 C.F.R. §1.913 directed to U.S. Patent No. 7,481,356, filed Jun. 4, 2010 (assigned U.S. Appl. No. 95/001,370).

Order Granting/Denying Request for Inter Partes Reexamination in Reexamination U.S. Appl. No. 95/001,370, dated Jul. 23, 2010.

Office Action in Inter Partes Reexamination in Reexamination U.S. Appl. No. 95/001,370, dated Jul. 23, 2011.

Response to Office Action in Reexamination U.S. Appl. No. 95/001,370, mailed Sep. 22, 2010.

Third Party Requester Seda S.P.A. Comments After Patent Owner Response Pursuant to 37 C.F.R. §1.947 in Reexamination U.S. Appl. No. 95/001,370, filed Oct. 21, 2010.

Action Closing Prosecution in Reexamination U.S. Appl. No. 95/001,370, dated Jan. 7, 2011.

Right of Appeal Notice in Reexamination U.S. Appl. No. 95/001,370, dated Apr. 25, 2011.

* cited by examiner

CARDBOARD CONTAINER FOR DRINKS AND PROCESS THEREFOR

This application is a continuation of application Ser. No. 10/470,431, filed on Dec. 30, 2003 now U.S. Pat. No. 7,100,770. Application Ser. No. 10/470,431 is the national phase of PCT International Application No. PCT/EP02/00346 filed on Jan. 15, 2002 under 35 U.S.C. §371, which claims priority of European Application No. 01830056.6 filed Jan. 30, 2001. The entire contents of each of the above-identified applications are hereby incorporated by reference.

DESCRIPTION

The present invention relates to a container for drinks and, more precisely, of a type having a laminated cardboard wall for allowing the gripping thereof when hot drinks be contained therein.

Several types of containers for hot drinks are already known, typically made in suitable materials like laminated cardboard, PET, foam polystyrene, which are stackable for the subsequent sale thereof.

The problem with the polystyrene, plastics, and also cardboard containers, ensues from the fact that those are prone to get stuck during the stacked storage thereof.

For the plastics or polystyrene containers, several solutions have been adopted which consist in obtaining thereon, during the mould forming thereof, projecting members apt to provide a support thereto during the stacking stage thereof, thus avoiding interference between the walls of a first container when it is stacked on a respective underlying second container.

In the instance of the laminated cardboard containers, it is provided that the container wall be made with two cardboard layers, sandwiched by a web apt to form an air gap. Thus, an insulating effect on the wall is attained. However, a problem of suchlike containers lies, given the wall compliance and the geometric configuration thereof, in their marked proneness to get stuck when stacked stored.

A container known from EP 10 31 514 A has an inwardly projecting, circumferential rib serving to keep the adjacent inner and outer walls of two nested containers at a distance.

A double-walled container known from U.S. Pat. No. 5,542,599 A has an inwardly protruding circumferential rib along the full extension of the inner container wall. Two nested containers become stuck due to intimate contact between the lower conical part of the outer wall of the inner container and the inner conical wall part of the outer container.

The intimate contact significantly hinders separation of the nested containers.

A double-walled nestable container known from GB 261 532 C has an inwardly extending circumferential shoulder at the inner container wall. The bottom wall of the inner container of two nested containers rests on the shoulder of the outer container. The double wall structure of the container extends into the double-walled container bottom. Two nested containers the inner container of which is seated on the shoulder of the outer container with the outer container wall of the inner container being in intimate contact with the inner wall of the outer container such that both containers easily get stuck within each other. This hinders and easy separation of the containers. The vertical nesting distance between the bottoms of the nested containers is relatively large since the bottom of the inner container cannot be moved past the shoulder of the outer container. This results in an undesirable top wall storage height of a plurality of nested containers and high transport costs.

Therefore, the object of the present invention is to overcome the abovementioned problems providing a cardboard container with laminated walls which be apt to be stacked and not be prone to get stuck onto another container when in the stacked condition.

Hence, according to the present invention a cardboard container for hot drinks, having a perimetral wall and a bottom wall, characterised in that it further comprises means for the supporting thereof when it is stacked arranged in a respective container, is provided.

The container of the present invention will hereinafter be better illustrated by a de-tailed description of a preferred embodiment thereof, given by way of example and not for limitative purposes, making reference to the annexed drawings, wherein.

Figure 1:
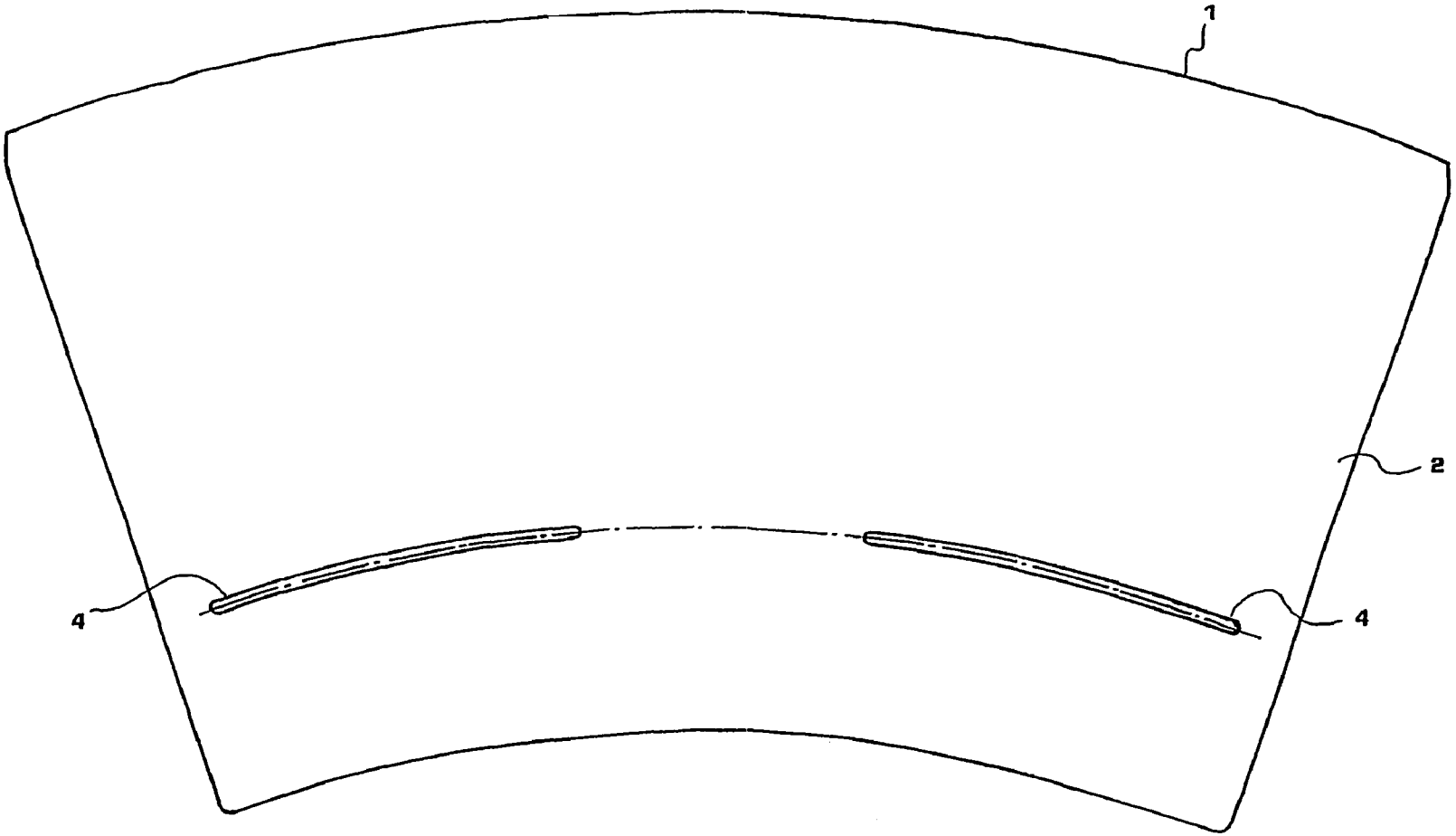
FIG. 1 is a plan view of a blank for the making of the container of the present invention.

With reference now to FIG. 1, a blank 1 apt to realise said container once assembled, having an outside surface 2 and an inside surface 3 (not shown in the Fig.) is illustrated.

According to a first process of the present invention, it is provided that onto the surface 2 a creasing 4, apt to project internally to the container once assembled, be obtained (better illustrated hereinafter).

Figure 2:
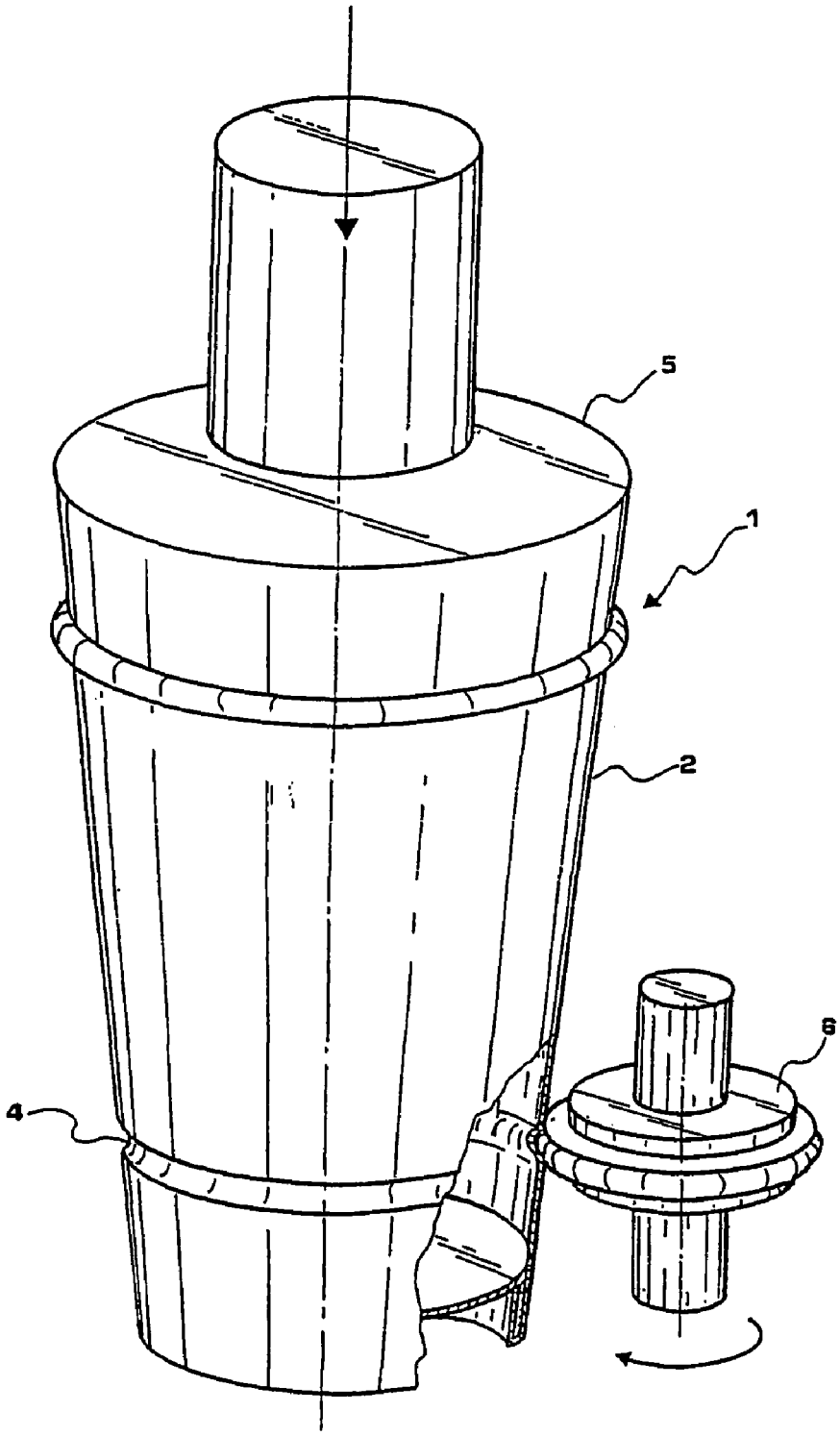
FIG. 2 is a schematic perspective view, partially illustrating a process for manufacturing the container of the present invention.

With reference to FIG. 2, an alternative process for manufacturing the container of the present invention is illustrated. For the sake of simplicity, same parts will be indicated by the same reference numbers.

According to such alternative process, it is provided that the container be formed with an uncreased blank 1, by arranging the former on a forming revolving supporting member 5. The revolving supporting member 5 has on its surface a perimetral groove apt to form a respective creasing 4 onto the outer surface 2 of the container 1 when the supporting member 5 revolvingly engages to a complementary knurl 6.

It has to be specified here that the complete apparatus and the related means for actuating the member 5 and the knurl 6 are not depicted in the Fig., as already comprised in the state of the art and, therefore, not forming part of the inventive scope of the present invention.

Figure 3:
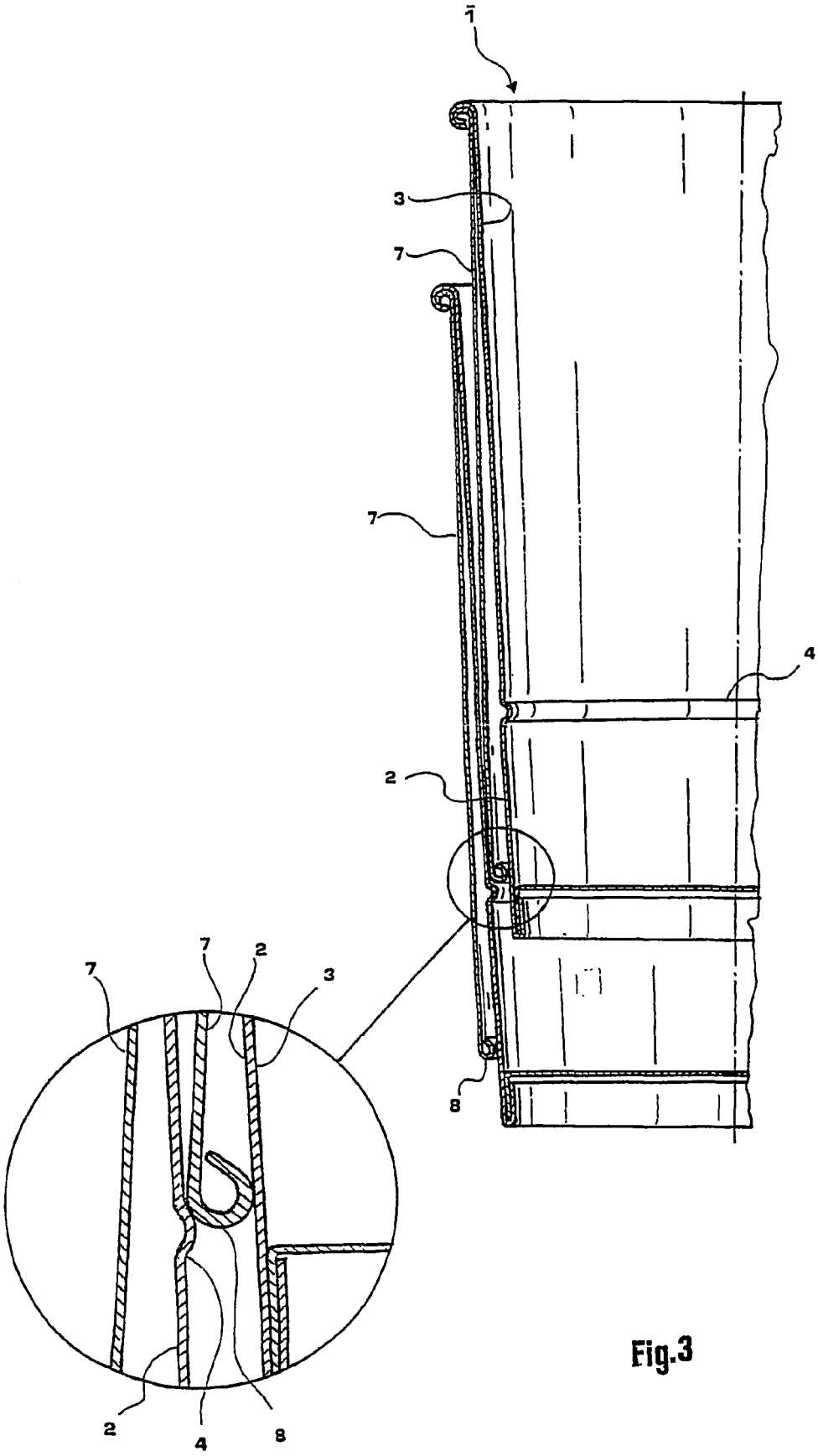
FIG. 3 is an elevational and partially sectional view illustrating the container of the present invention in a stacked condition.

Making now reference to FIG. 3, in a partial section an embodiment of the container 1 manufactured with the process of the present invention is illustrated.

According to the present embodiment of the container, the latter is provided with a laminated wall wherein a second outside wall 7 fixedly arranged onto the container 1 with a respective forming step already known to the state of the art, is provided. This arrangement allows the manufacturing of a container 1 apt to provide an insulating effect onto the wall 7 and 2 by virtue of the presence of an air gap, hence being particularly suitable for hot drinks.

As it is apparent from the Fig., the forming of a creasing 4 allows a perfect stackablity of a container 1 with respect to another identical one by virtue of the fact that the edge 8 of the second outside wall 7 is apt to rest onto the creasing 4 when the container 1 is inserted in another container 1. The arrangement of the creasing 4 allows to prevent a container 1, once inserted into another container 1, from getting stuck onto the outer walls of the latter. In fact, by virtue of the support provided by the creasing 4 to the out-side wall 7, the container 1 is thus maintained in position without making the outside wall 7 thereof adhere onto the inside wall 3 of a respective underlying container 1, thus avoiding a stuck-up thereof.

It has to be pointed out that the present invention is also applicable to containers having an individual plain wall 2 wherein the contact is avoided by interference of the creasing 4 onto the outside wall 2 of a respective container 1 in the stacked condition.

The invention claimed is:

1. A cardboard container, comprising:

a perimetral wall having an upper end and a lower end, a bottom wall attached to the lower end of said perimetral wall, an outside wall surrounding said perimetral wall, an upper end of said outside wall arranged to the upper end of said perimetral wall, a lower edge of said outside wall having an inward curl that is disposed against the lower end of said perimetral wall above an uppermost surface of said bottom wall such that a lowermost vertical portion of said perimetral wall is visible, and a heat-insulating air gap defined between said outside wall and said perimetral wall, wherein said perimetral wall comprises at least one inwardly extending projection configured to support a corresponding lower edge of a corresponding outside wall of a further container when stackedly arranged inside said container.

2. The container according to claim 1, wherein said projection is integrally formed with said perimetral wall.

3. The container according to claim 1, wherein said projection is a creasing perimetrally formed on said perimetral wall.

4. The container according to claim 3, wherein said creasing is obtained in at least one circumference segment on said perimetral wall.

5. The container according to claim 1, wherein said outside wall and said perimetral wall are joined at the upper end of said perimetral wall so that said heat-insulating gap is closed at the upper end of said perimetral wall and at said lower edge of said outside wall.

6. The container according to claim 1, wherein said heat-insulating gap is increased in the region of said projection, said heat-insulating gap extends in a circumferential direction of the container and extends between the lower edge of said outside wall and the upper end of said outside wall.

7. The container according to claim 6, wherein, a thickness of said heat-insulating gap between said perimetral wall and said outside wall is essentially uniform along the circumference of said perimetral wall at any height from said bottom wall, and a thickness of the heat-insulating gap decreases, except at said projection, from a height adjacent the lower edge of said outside wall towards the upper end of said outside wall.

8. The container according to claim 6, wherein, said perimetral wall contacts said outside wall only at the upper end of said outside wall and at said lower edge of said outside wall.

9. A process for manufacturing a cardboard container which comprises the following steps:

providing a blank;

obtaining a perimetral creasing on said blank onto a surface forming a wall of said container; and assembling said blank so as to manufacture said container;

wherein said cardboard container has a perimetral wall, a bottom wall and an outside wall surrounding said perimetral wall with a heat-insulating air gap being defined between said outside wall and said perimetral wall, wherein said perimetral wall comprises said perimetral creasing as an inwardly extending projection configured to support a lower edge of the outside wall of a further container when stackedly arranged inside said container, the lower edge of the outside wall having an inward curl that is disposed against the lower end of said perimetral wall above an uppermost surface of said bottom wall such that a lowermost vertical portion of said perimetral wall is visible, and wherein the heat-insulating gap is increased in the region of the projection, the heat-insulating gap extends in circumferential direction of the container and extends between the lower edge and an upper end of said outside wall.

10. The process according to claim 9, wherein said outside wall and said perimetral wall are joined at an upper end of said perimetral wall so that said heat-insulating gap is closed at the upper end of said perimetral wall and at said lower edge of said outside wall.

11. A process for manufacturing a cardboard container, which comprises the following steps:

providing a blank;

arranging said blank on a revolving supporting member to form said container; and forming a perimetral creasing during formation of said container with a related complementary knurl adapted to cooperate with said supporting member;

wherein said cardboard container has a perimetral wall, a bottom wall and an outside wall surrounding said perimetral wall with a heat-insulating air gap being defined between said outside wall and said perimetral wall, wherein said perimetral wall comprises said perimetral creasing as an inwardly extending projection configured to support a lower edge of the outside wall of a further container when stackedly arranged inside said container, the lower edge of the outside wall having an inward curl that is disposed against the lower end of said perimetral wall above an uppermost surface of said bottom wall such that a lowermost vertical portion of said perimetral wall is visible, and wherein the heat-insulating gap is increased in the region of the projection, the heat-insulating gap extends in circumferential direction of the container and extends between the lower edge and an upper end of said outside wall.

12. The process according to claim 11, wherein said outside wall and said perimetral wall are joined at an upper end of said perimetral wall so that said heat-insulating gap is closed at the upper end of said perimetral wall and at said lower edge of said outside wall.

13. A container comprising:

a perimeter wall having an upper end and a lower end;

a bottom wall attached to the lower end of the perimeter wall;

an outside wall surrounding the perimeter wall, an upper end of the outside wall extending to the upper end of the perimeter wall, a lower edge of the outside wall having an inward curl that is disposed against the lower end of the perimeter wall above an uppermost surface of the bottom wall such that a lowermost vertical portion of the perimeter wall is visible; and a heat-insulating air gap defined between the outside wall and the perimeter wall, the perimeter wall having at least one inwardly extending projection configured to support a corresponding lower edge of a corresponding outside wall of a further container when the further container is stacked within the container.

14. The container according to claim 13, wherein the projection includes at least one creasing circumferentially formed into the perimeter wall.

15. The container according to claim 13, wherein the heat-insulating air gap increases in size from the upper end of the outside wall to the lower edge of the outside wall.

* * * * *